US006053377A

United States Patent [19]

Beverly

[11] Patent Number: 6,053,377

[45] Date of Patent: Apr. 25, 2000

[54] WOODEN GARMENT HANGER AND METHOD FOR MAKING SAME

[76] Inventor: Keith Beverly, 352 Seadrift Rd., Stinson Beach, Calif. 94970

[21] Appl. No.: 09/151,639

[22] Filed: Sep. 11, 1998

[51] Int. Cl.[7] ..... A47G 25/30

[52] U.S. Cl. ..... 223/85; 223/92

[58] Field of Search ..... 223/85, 92, 88, 223/95; D6/315

[56] References Cited

U.S. PATENT DOCUMENTS

| | | | |
|---|---|---|---|
| 2,912,149 | 11/1959 | Stuard | 223/92 |
| 4,185,768 | 1/1980 | Treiman | 223/85 |
| 4,653,678 | 3/1987 | Blanchard et al. | 223/85 |
| 5,069,373 | 12/1991 | Kolton et al. | 223/85 |
| 5,071,045 | 12/1991 | Hollis | 223/85 |
| 5,381,938 | 1/1995 | Yasudeva | 223/85 |

*Primary Examiner*—Bibhu Mohanty

*Attorney, Agent, or Firm*—Oppenheimer Wolff & Donnelly LLP

[57] ABSTRACT

A wooden garment hanger having a pair of outwardly extending arms with interlocking shoulder notches formed in the upper surface of each arm. Each notch is formed with a rectangular channel having a longitudinal axis extending generally parallel to the longitudinal axis of the arms with spaced finger elements overlying the channel and forming an opening leading into the channel.

8 Claims, 4 Drawing Sheets

WOODEN GARMENT HANGER AND METHOD FOR MAKING SAME

BACKGROUND OF THE INVENTION

1. Field of the Invention

The invention relates to garment hangers; and, more particularly, to hangers having spaced shoulder notches for retaining garments thereon and the method of making the same.

2. Related Art

Garment hangers having spaced notches for hanging garments therefrom are well known in the art. Such hangers are of plastic but, so far, wooden garment hangers which contain interlocking shoulder notches similar to those which are commonly produced in plastic garment hangers have not been available. Interlocking notches securely contain the shoulder strap of a garment within the confines of the notch. Due to the large increase of usage of wooden garment hangers in the retail apparel industry, there is a significant need for economically priced interlocking shoulder notches in wooden hangers.

Whereas a strong, functional, and smoothly finished interlocking notch can be easily produced for virtually no cost in molded plastic hangers, it had been a far more difficult matter and more costly procedure to produce interlocking notches in wooden garment hangers. The primary hindrances of producing interlocking notches in wooden hangers were:

A) Extreme weakness of the two thin wooden finger elements which form the top section of the interlocking notch.

B) Expensive and difficult process of smoothly cutting, sanding, and applying numerous coatings of finishing material within the confines of the narrow rectangular channel area of the notches' interior surfaces.

C) The need to increase the surface area, thus increasing the raw material costs, of existing wooden hanger designs in order to provide sufficient strength and working area to produce a functional interlocking notch.

There is thus a need for a wooden garment hanger having spaced interlocking notches and a method for economically and easily manufacturing the same.

SUMMARY OF THE INVENTION

It is an object of this invention to provide a wooden garment hanger having spaced interlocking garment retaining notches.

It is a further object of this invention to provide a method for forming a garment hanger out of wood having spaced interlocking garment retaining notches.

These and other objects are preferably accomplished by providing a wooden garment hanger having a pair of outwardly extending arms with interlocking shoulder notches formed in the upper surface of each arm. Each notch is formed with a rectangular channel having a longitudinal axis extending generally parallel to the longitudinal axis of the arms with spaced finger elements overlying the channel and forming an opening leading into the channel.

DESCRIPTION OF THE PREFERRED EMBODIMENT

Figure 1:
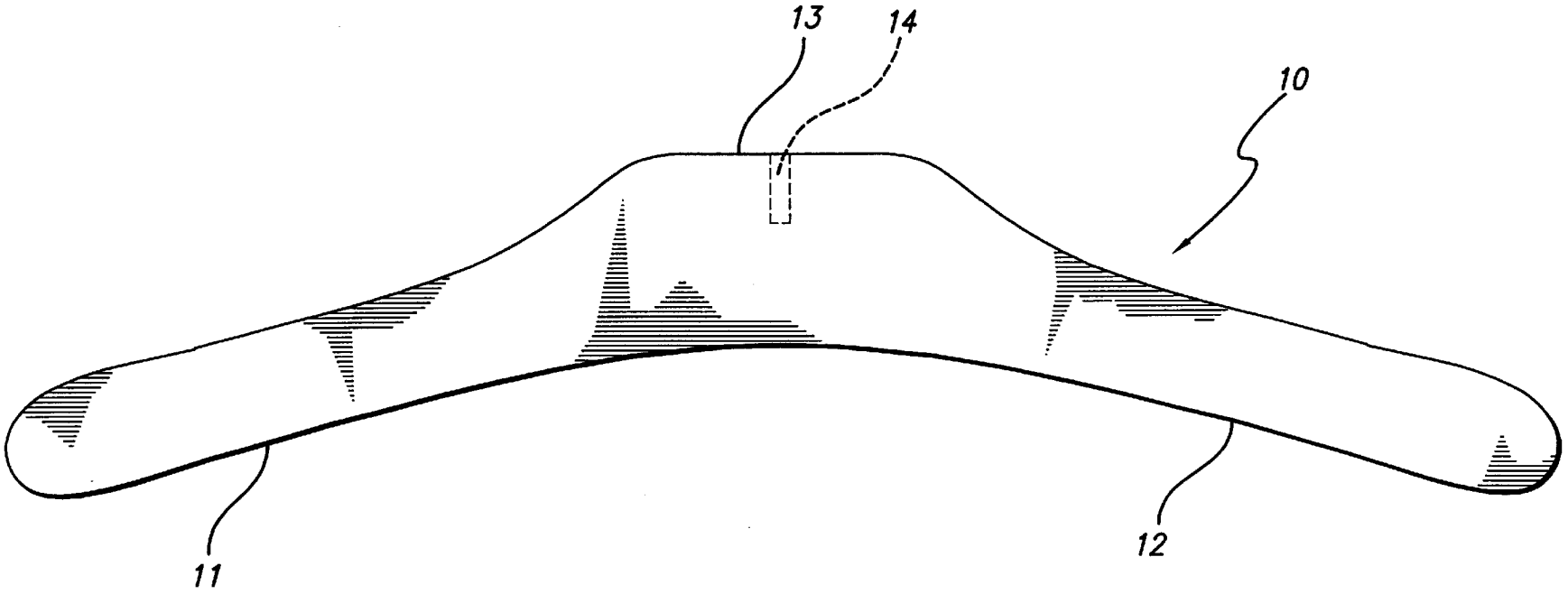
FIG. 1 is an elevational view of a blank for forming the coat hanger of the invention, the blank having been previously shaped to about 1/32" of its finished form.

Referring now of the drawings, FIG. 1 is an elevational view of a piece of wood which is a roughly formed blank for a hanger body. Thus, blank 10 has a pair of arms 11, 12 extending outwardly from center portion 13. A hole 14, shown in dotted lines, may be formed in the upper surface 13 of blank 10 for receiving a hook therein.

Blank 10 may be a single piece of wood or formed from two or more segments. Blank 10 may be about 1/4" thick, arms 11, 12 may be about 5 3/4" long from the upper closest corner of main body portion 13. Blank 10 is also shown as having been shaped with cutters to within approximately 1/32" of its finished perimeter form.

Figure 2:
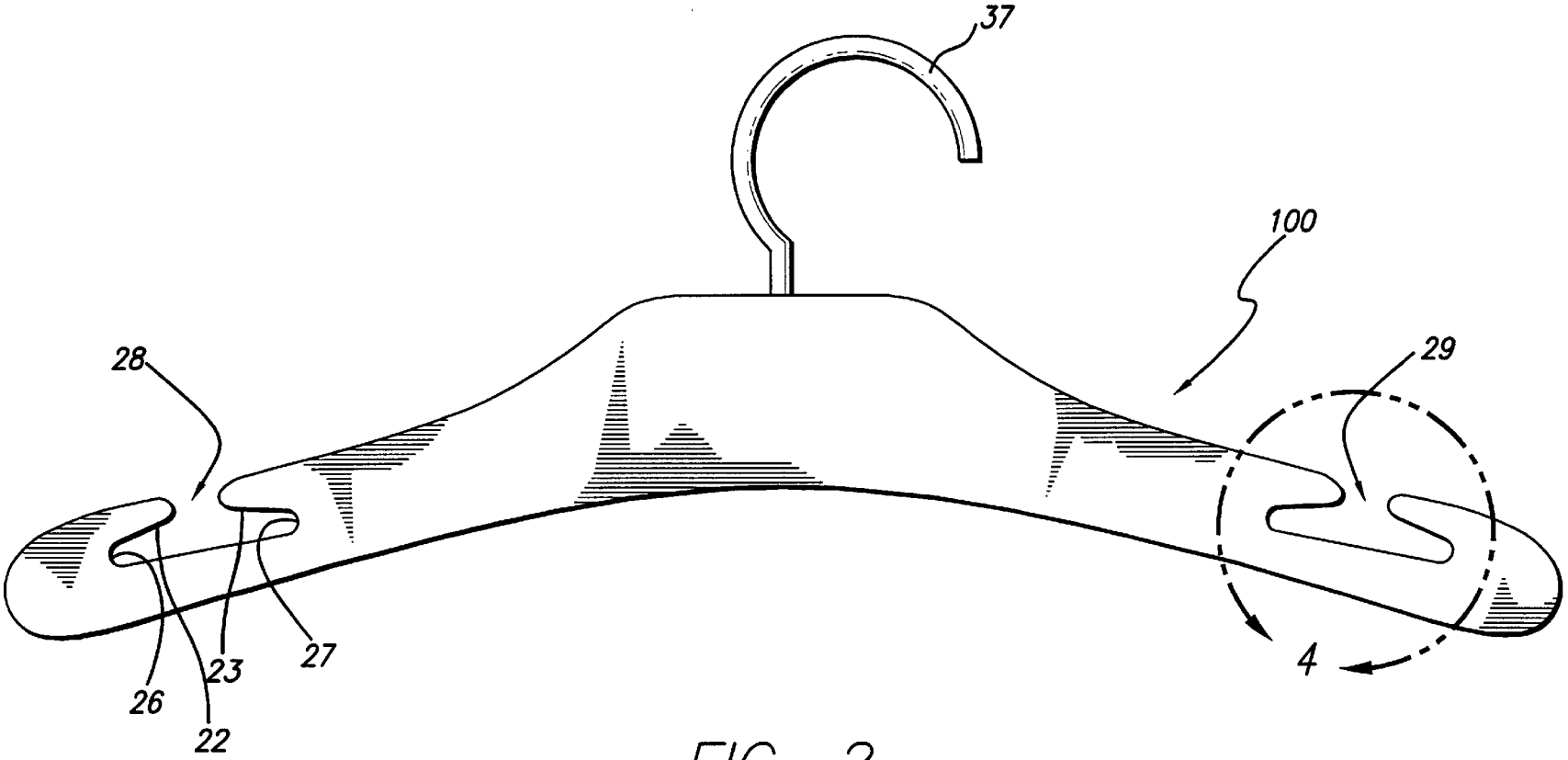
FIG. 2 is an elevational view of the finished coat hanger of the invention.
Figure 3:
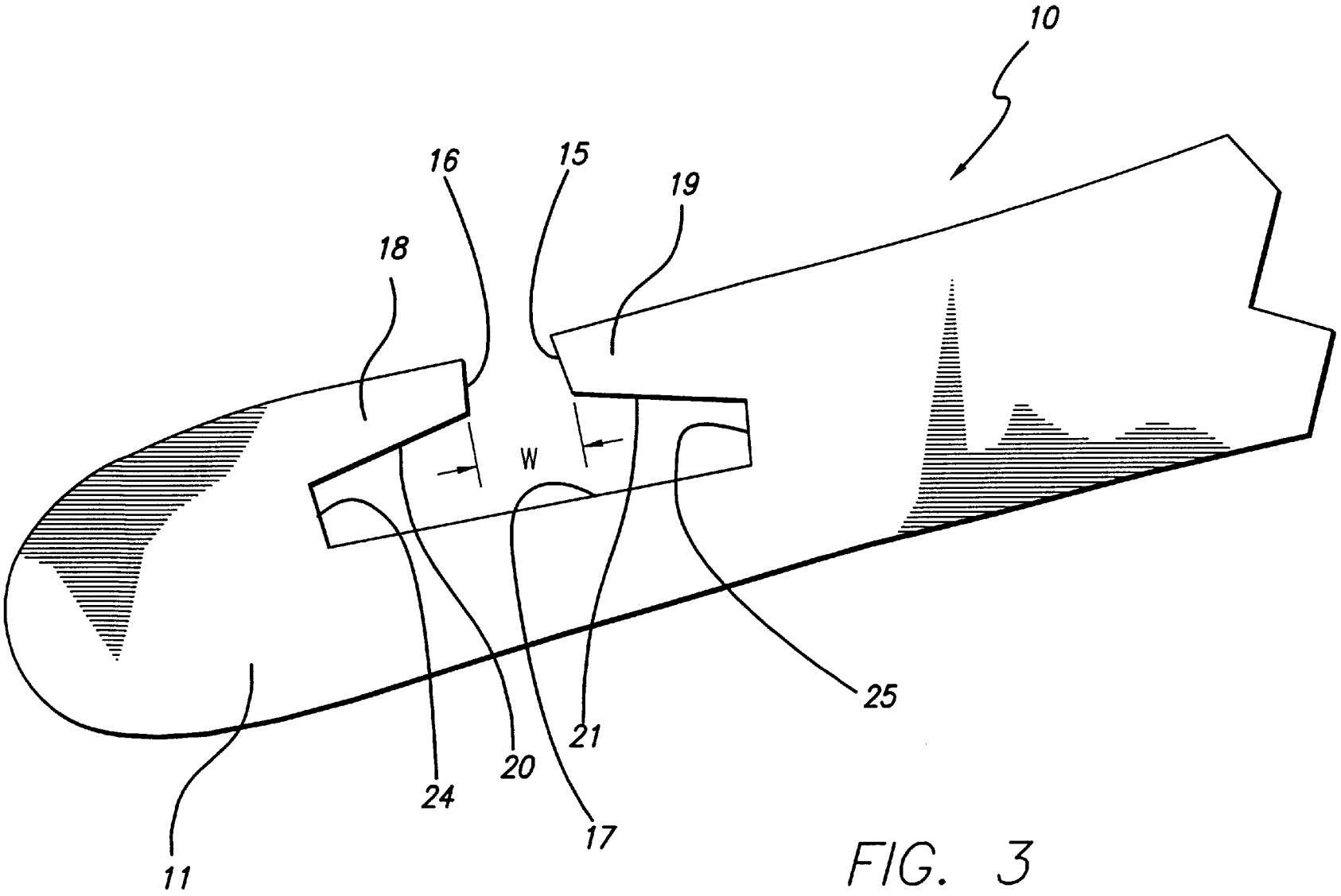
FIG. 3 is an elevational view of the first step in cutting of the blank of FIG. 1.

Although a single blank 10 as in FIG. 1 can be formed into the final coat hanger shown in FIG. 2, in the manufacturing process a plurality, such as 10, of blanks similar to blank 10 can be placed together and clamped inside a carriage connected to a machine containing the initial cutting device. However, such a blank can be cut manually and, thus, as particularly contemplated in the present invention, as seen in FIG. 3, a triangular-shaped cut 15 with an opening leading into the triangular portion is made through upper surface 13 of each arm 11, 12 having a first vertical portion 16 and a second horizontal portion 17. This forms about 70% of the final lateral portion 18 shown in FIG. 2. Vertical portion is formed to be about 1/4" wide and about 9/16" deep. Also, approximately midway through the vertical portion 16 of the opening leading into horizontal portion 17, and at an angle of approximately 12 degrees to the vertical, the opening is widened on each side so at the base (where vertical portion 16 intersects horizontal portion 1), the width of the vertical opening is increased to approximately 1 inch.

If a plurality of blanks are being cut, they are then transferred to a carriage connected to a machine which contains the secondary cutting device.

Figure 4:
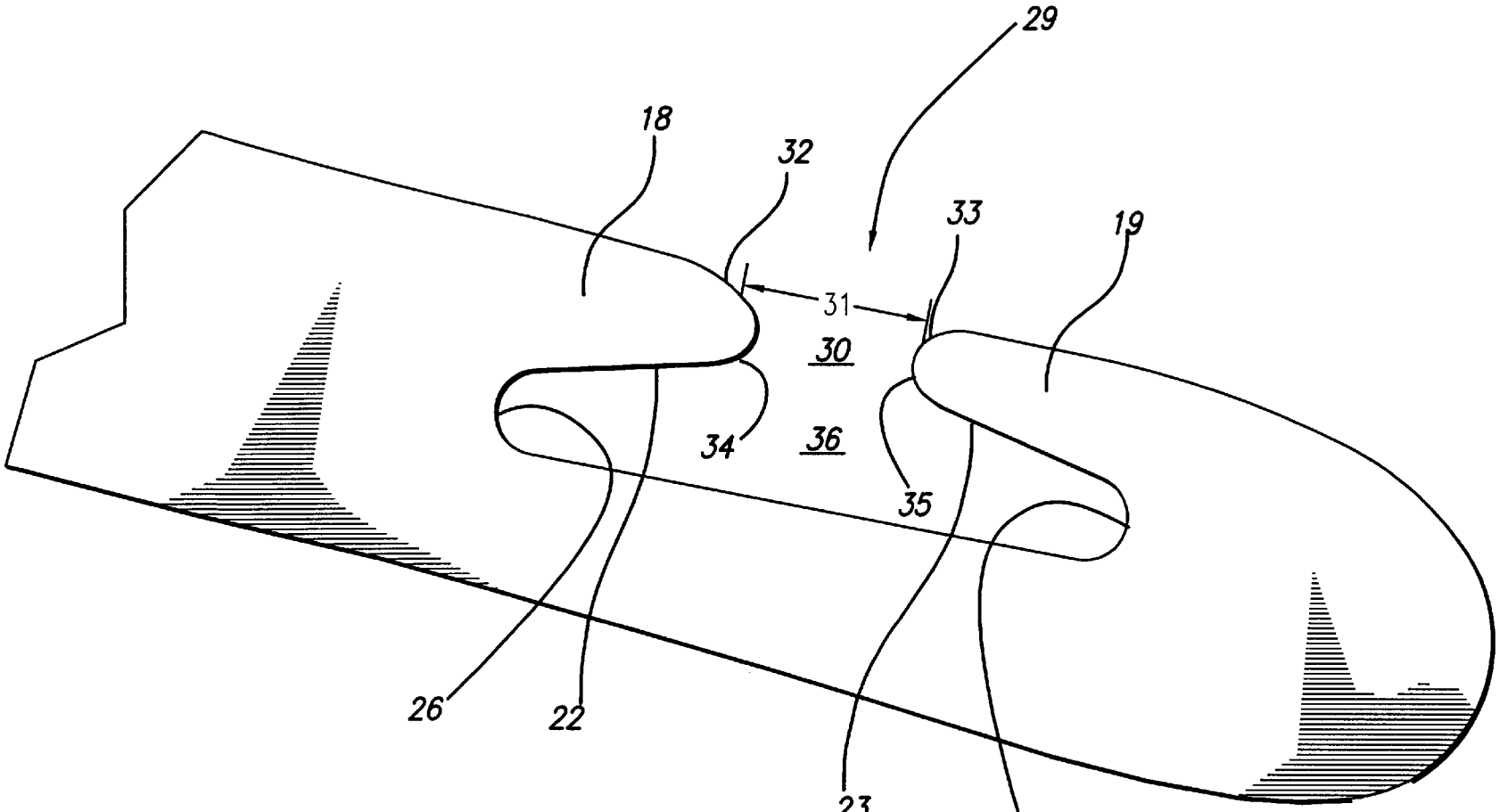
FIG. 4 is a detailed view taken along line 4 of FIG. 2 illustrating the final formation of one of the notches of the coat hanger.

In this next step, the inwardly extending tips of the fingers, 18, 19, which form the top section of the notch being formed, are rounded using any suitable tool and the opening between the fingers 18, 19 is increased to approximately 3/8 inches. Simultaneously, the width W (FIG. 4) at the base of the opening is expanded to form the desired final width which is generally about 1½ to 2 inches. Additionally, the angle of the upper portions 20, 21 of horizontal portion 17 are increased to its finished slope of approximately 15 degrees with respect to the longitudinal axis of horizontal portion 17. This is seen at portions 22, 23, respectively, in FIG. 2. Lastly, this secondary cutting device shapes the two bottom corners 24, 25 to an arch of approximately 255 degrees. This is shown at corners 26, 27, respectively, in FIG. 2.

Both notches 28, 29 in FIG. 2 are formed in like manner. The garment hanger, including the interior surfaces of the notches 28, 29, is sanded using both manual and automated sanding devices.

The final process is the application of various coatings of finishing material forming the hanger shown in FIG. 2.

Each notch 28, 29 in FIG. 2 thus has a first vertical portion 30 (see FIG. 5) with an opening 31 leading therein having rounded corners with a radius curvature of about 160 degrees at corners 32, 33, 34, and 35. Vertical portion 30 leads into horizontal portion 36 having an arch of about 255 degrees at each corner 26, 27. Fingers 18, 19, on their undersides, slope from corners 34, 35, respectively, down to corners 26, 27, respectively, at an angle of about 15 degrees with respect to the longitudinal axis of horizontal portion 36.

The thickness of fingers 18, 19 varies from 3/16 inches to 7/16 inches from a point adjacent corners 26, i.e., the base of the finger, out to the rounded tip thereof. The spacing between the rounded tips of adjacent fingers 18, 19 is about 3/8 inches. The horizontal portion 36 of the notches 28, 29 extends from corner 26 to corner 27 about 1½ to 2 inches. The height of horizontal portion 36 from one corner to the rounded tip of its overlying finger (such as corner 26 to the rounded tip corner 34) varies from about 3/16 inches to 3/8 inches.

The final hanger 100 is shown in FIG. 2, is a conventional hook having been inserted into hole 14 (FIG. 1). Hanger 100 (FIG. 2) has spaced notches 28, 29 into which straps or the like of garments can be placed.

There is thus described a unique method of making interlocking notches in wooden garment hangers that remedies the structural, production, and economic problems of the past. Applicant's method consists of cutting downward sloping fingers to form the top sections of the interlocking notches. The downward sloping fingers are cut to a distance of approximately one-half of the face width of the arms 11, 12. This method produces the following results:

A) Formation of the fingers by a downward sloping cutting method creates a progressively thicker and stronger finger element thereby, offsetting the leverage effect, and the related increased susceptibility to breakage, as the length of the finger extends outwardly from the centerline of the notch.

B) This method of cutting a downward sloping finger produces a notch which has an enlarged interior cut-out area. This enlarged notch area provides sufficient access and working area to economically sand and mechanically apply coatings of finishing material. It should be noted that to achieve a marketable interlocking notch in a wooden hanger, it is essential that the interior surfaces of the notch be completely smooth to avoid snagging or otherwise damaging delicate fabrics. It should also be noted that a narrow straight interlocking notch, similar to those of plastic hangers and those cut into wood, cannot be economically finished to the same consistent degree of smoothness as an enlarged notch produced by applicant's method.

C) Utilizing the method of cutting a downward sloping finger eliminates the need to increase the surface area of the hanger to compensate for the loss of strength to the diminished wood section directly underneath the notch. The section of wood directly underneath the notch would be weakened to an unacceptable degree if thick (adequately strong) straight instead of sloped fingers were cut into an existing wooden hanger design; and, if the vertical area of the resulting rectangular notch section was enlarged sufficiently to allow economical finishing of the interior surfaces of the notch.

Any suitable tools, such as hand saws, routers, etc. may be used to cut the notches. For example, a commercial router manufactured by Onsrud Machine Corp. of Wheeling, Ill., Model No. 3025, may be used.

Although various materials may be used, the invention herein is primarily directed to wooden coat hangers, usually made of various hardwood species, such as maple, beech, etc.

Although a particular embodiment of the invention is disclosed, variations thereof may occur to an artisan and the scope of the invention should only be limited by the scope of the appended claims.

I claim:

1. A method for forming a wooden garment hanger comprising the steps of:

forming a blank made of wood having a main body portion and a pair of integral outwardly extending spaced arms having an upper surface and a lower surface;

forming a triangular-shaped notch with an opening leading into the triangular portion thereof through each of said arms having a first vertical portion extending through the upper surface of each of said arms and an integral horizontal portion terminating in a pair of corners thereby forming a pair of spaced inwardly extending fingers having a pair of ends and said arms overlying each of said horizontal portions, wherein the method step to form said triangular-shaped notch includes the steps of:

a) forming the vertical opening having a triangular shaped cut leading to said triangular portion;

b) widening said vertical opening laterally along and at an angle from the vertical axis of said arms;

c) rounding the ends of said fingers about said vertical opening;

d) enlarging the width of said triangular portion;

e) increasing the angle of said arms along the horizontal portion from the ends to the corners; and f) rounding the corners.

2. The method of claim 1 wherein the step of cutting said notch includes the step of cutting said vertical opening to a width of about ¼ inches and an angle of about 12 degrees to each side of said vertical axis.

3. The method of claim 2 wherein the step of cutting said notch includes the step of cutting said vertical opening at a depth of about 9/16 inches.

4. The method of claim 1 wherein the step of rounding off said tips includes the step of rounding off said tips until the spacing between the ends of said fingers is about 3/8 to ½ inches.

5. The method of claim 4 wherein the step of rounding off said tips includes the step of rounding off said tips until the spacing between the corners of said horizontal portion is about 1½ to 2 inches.

6. The method of claim 1 wherein the step of forming said fingers further includes the steps of forming said fingers each having an underside extending at an angle of about 15 degrees with respect to the longitudinal axis of said horizontal portion tapering inwardly and downwardly from said ends toward the corners of said horizontal portion.

7. The method of claim 1 wherein the step of rounding off said corners includes the step of rounding off each of said corners to an arch of approximately 255 degrees.

8. The method of claim 1 further comprising the step of applying a coating of finishing material.

* * * * *